United States Patent [19]

Segan et al.

[11] 4,250,787

[45] Feb. 17, 1981

[54] MUSIC TONE GENERATOR

[75] Inventors: Marc H. Segan; Sayre A. Swarztrauber, both of New York, N.Y.

[73] Assignee: Calfax, Inc., New York, N.Y.

[21] Appl. No.: 268

[22] Filed: Feb. 1, 1979

[51] Int. Cl.[3] ..... G10H 7/00

[52] U.S. Cl. ..... 84/1.01; 84/1.03; 84/464 R

[58] Field of Search ..... 84/1.01, 1.03, 1.22, 84/1.23, 464, DIG. 8, DIG. 12, 464 R, 464 A; 364/900, 200

[56] References Cited

U.S. PATENT DOCUMENTS

| | | | |
|---|---|---|---|
| 3,889,568 | 6/1975 | Amaya | 84/1.01 |
| 3,971,283 | 7/1976 | Wayne, Jr. | 84/DIG. 8 |
| 3,992,973 | 11/1976 | Howell | 84/1.23 |
| 4,016,540 | 4/1977 | Hyatt | 364/900 |
| 4,022,097 | 5/1977 | Strangio | 84/1.03 |
| 4,058,043 | 11/1977 | Shibahara | 84/1.03 |
| 4,060,848 | 11/1977 | Hyatt | 364/200 |

FOREIGN PATENT DOCUMENTS

| | | | |
|---|---|---|---|
| 2547632 | 4/1977 | Fed. Rep. of Germany | 84/DIG. 12 |

OTHER PUBLICATIONS

Heathkit Continuing Education Individual Learning Program Microprocessors, Unit 7, Interfacing-Part 1, EE-3401, Heath Company Benton Harbor, Michigan, 49022, ©1977, pp. 10-71-82.

National Semiconductor COP420/COP421 Single--Chip N-Channel Microcontrollers, National Semiconductor Corporation, Jun. 1978.

*Primary Examiner*—S. J. Witkowski

[57] ABSTRACT

A device for producing a plurality of musical tones comprises a programmed rectangular wave generator that produces a series of rectangular waves of the same amplitude for each tone. Each wave in each of the series of waves has a predetermined energy content and drives a speaker or other sound producing transducer such that the musical tone produced has the same aural qualities as that produced by a musical instrument. In the preferred embodiment the wave generator is a programmed integrated circuit microcomputer having a Read Only Memory in which are stored the sequence of notes of one or more musical compositions that are played under program control. The device is particularly adapted to produce bell tones having minimum harmonic distortion which, in combination with micro-miniature speakers and lights in bell shaped translucent housings and driven by the series of rectangular waves, becomes an attractive Christmas decoration that plays a number of traditional Christmas carols.

8 Claims, 6 Drawing Figures

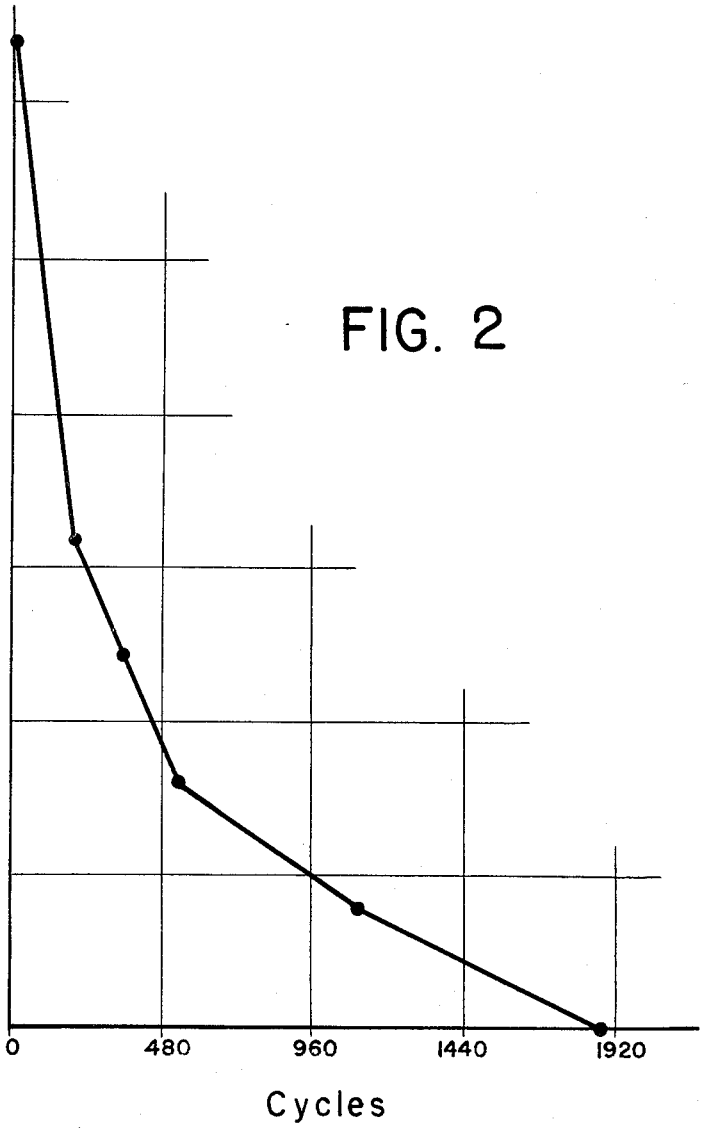
FIG. 2
FIG. 5
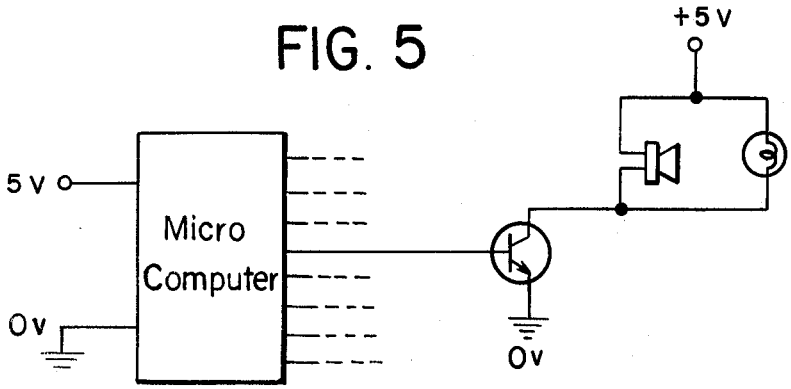

MUSIC TONE GENERATOR

TECHNICAL FIELD

The present invention relates to devices for producing musical tones using programmed digital electronic circuits.

BACKGROUND ART

Previous systems for producing music electronically have been based on analog signal processing techniques. Typical of such systems are electronic organs which have special oscillator type frequency generators for each frequency signal. These signals are summed using special filters to provide the desired musical tone signals to a speaker system. Such analog systems are of necessity many orders of magnitude larger than the digital system of the present invention.

U.S. Pat. Nos. 4,016,540 and 4,060,848 issued to Gilbert Peter Hyatt disclose an audionic musical instrument using a digital data processor, under program control, to generate complex time and amplitude relationships in the digital domain providing composite signal samples in digital form which are then converted to analog signals using a digital to analog (D/A) converter. These analog signals are used to drive a speaker system thereby producing the desired music sounds.

The musical tone generator of the present invention uses a programmed digital circuit to provide for each musical tone a series of rectangular waves of the same amplitude and period, each wave of which has a predetermined energy content. This series of rectangular waves, amplified if necessary, directly drives a speaker or other sound transducer to provide musical tones having extremely high fidelity to the tones produced by a musical instrument giving them substantially the same aural qualities as those produced by the actual instrument. In addition, the musical tone generator of the present invention can be implemented in microminiature integrated circuits many orders of magnitude smaller than the analog circuits or data processors and digital to analog converters of the prior art.

DISCLOSURE OF INVENTION

The present invention is an electronic digital musical tone generator utilizing programmed digital logic to provide musical tones of substantially the same aural qualities as those produced by an actual musical instrument. The device of the invention uses a programmed rectangular wave generator to produce for each tone a series of rectangular waves of the same amplitude and period, each wave of which has a predetermined energy content. This series of rectangular waves is used to drive either directly or through appropriate amplification a speaker or other sound transducer. Control of the energy content of the waves is provided by appropriate programming of the digital logic of the wave generator, thereby permitting adjustment of the amount and timing of the delivery of the driving force to the sound transducer. By appropriate adjustments in energy content and by utilizing the characteristics of the particular sound transducer, different musical tones having substantially the same aural characteristics as those of a number of musical instruments can be produced.

More specifically, the rectangular wave generator is an integrated circuit microcomputer programmed to produce for each of a plurality of musical tones a series of rectangular waves of the same amplitude and period, each wave of which has a predetermined energy content.

By storing the sequence of notes of one or more musical compositions in a Read Only Memory (ROM) associated with the microcomputer, the musical composition can be played by producing, under program control, the appropriate series of rectangular waves for each tone corresponding to each note and by driving one or more speakers or other sound transducers in the stored sequence.

In a preferred embodiment an integrated circuit microcomputer is programmed to produce fifteen tones by generating fifteen different series of rectangular waves of the same amplitude and period. The fifteen tones are bell tones that are obtained by controlling the energy content of each wave such that maximum available driving power is initially applied to an output speaker, which power is first rapidly decreased and then more gradually decreased, giving the tone produced the necessary percussive sound of a struck bell. The aural quality of the bell sound is further enhanced by driving the speaker at a frequency close to the highest it can efficiently produce, which prevents the speaker from reproducing harmonics present in the driving signal.

One application of the preferred embodiment utilizes microminiature speakers and lights which are in translucent bell shaped housings. Both the speakers and the lights are driven by the amplified output of the programmed microcomputer. The note sequences of a number of traditional Christmas carols are stored in a Read Only Memory in the microcomputer and are played under control of the stored program providing a unique Christmas ornament having both light and sound associated with each bell as it is "rung".

BRIEF DESCRIPTION OF THE DRAWINGS

The advantages, nature and various features of the invention will appear more fully upon consideration of the various illustrative embodiments now to be described in detail in connection with the accompanying drawings. In the drawings:

FIG. 2 is a graphical illustration of the predetermined energy content of a series of rectangular waves.

FIG. 5 shows the output circuit of one of the outputs of the bell tone generator depicted in FIG. 4.

BEST MODE FOR CARRYING OUT THE INVENTION

Figure 1:
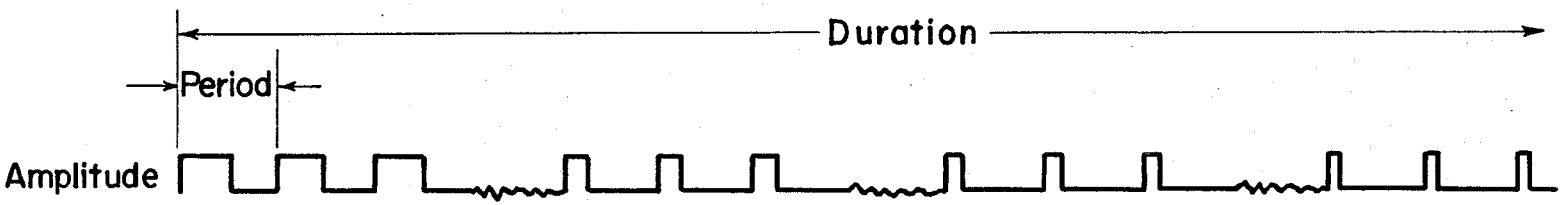
FIG. 1 is a segmented graphical depiction of an illustrative series of rectangular waves produced by the programmed rectangular wave generator of the invention.

Referring to FIG. 1 there is shown a graphical depiction of portions of a series of rectangular waves which illustrate the varying energy content of the individual waves in the series. Such a series of rectangular waves, with each individual wave having a predetermined energy content, is produced for each of a plurality of tones by a programmed rectangular wave generator.

The wave generator is a digital device operated by binary digital logic and its output is a series of logical "1"s and "0"s, thereby producing a series of rectangular waves having an amplitude equal to the logical "1" state of the device. In the preferred embodiment the programmed rectangular wave generator is an integrated circuit microcomputer. One suitable microcomputer is the COP420/COP421 Single Chip N-Channel Microcontrollers manufactured and sold by National Semiconductor Corp., 2950 Semiconductor Drive, Santa Clara, California, a block diagram of which is shown in FIG. 3.

The period of the rectangular wave may be varied to obtain the desired aural qualities. One constraint on the period is the operational cycle time of the digital device and another is the frequency characteristics of the output transducer. In the example of the bell tone generator depicted in FIGS. 4 and 5 a microminiature speaker having an operating range of 300 HZ to 3000 HZ was used and a bell tone having the same aural qualities as those of a tuned music bell were obtained by operating at a frequency of 1800 HZ to 2800 HZ, which is close to the highest frequency at which this speaker can efficiently operate. The choice of a frequency in this range prevents production of harmonics, thereby greatly enhancing the clarity of the bell tone.

Referring again to FIG. 1 it will be noted that the length of time that each rectangular wave remains in the logical "1" state and hence the energy content of each wave diminishes from the beginning to the end of the series of rectangular waves. This variation is controlled by the digital logic of the rectangular wave generator and is chosen to obtain a musical tone of the desired aural qualities. In the bell tone generator application of the preferred embodiment the energy content is initially at a maximum and decreased rapidly at first and then more gradually, thereby producing the percussive sound of a struck bell. A graphical representation of the variation of the energy content typical of a series of rectangular waves used to produce a bell tone in accordance with the preferred embodiment of the invention is shown in FIG. 2.

Figure 4:
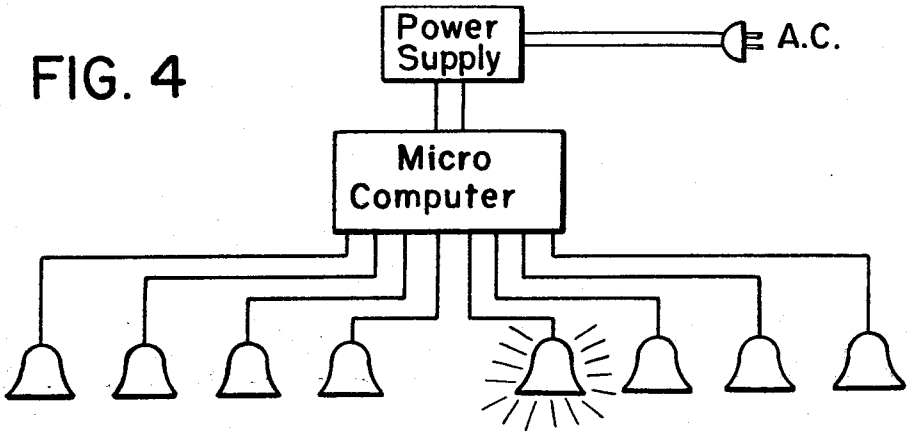
FIG. 4 is a block diagram of an application of the preferred embodiment of the invention as a bell tone generator.
Figure 3:
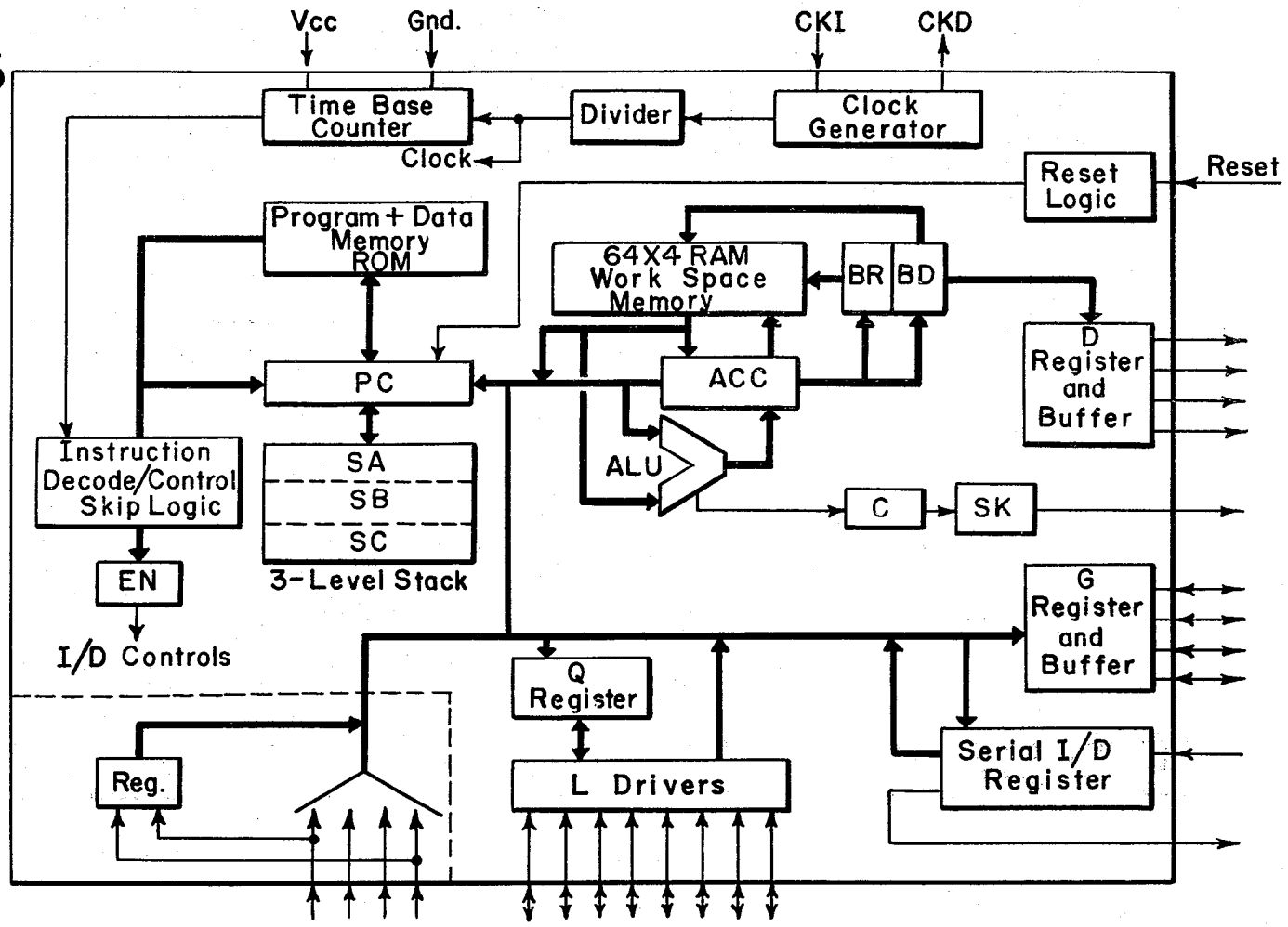
FIG. 3 is a block diagram of a commercially available microcomputer utilized in a preferred embodiment of the invention.

Referring now to FIG. 3 there is shown a block diagram of the National Semiconductor COP420/COP421 microcomputer used in the bell tone generator application of the preferred embodiment. The microcomputer includes a Read Only Memory (ROM), labeled Program and Data Memory in FIG. 3, in which is stored a program for producing a series of rectangular wave trains for fifteen different bell tones. These wave trains are selectively provided to the outputs of the microcomputer designated L Drivers. These outputs are connected to eight output circuits of the type shown in FIG. 5. The ROM of the microcomputer also stores the note sequence of from eight to eleven popular Christmas songs, which are played under control of the program by directing the appropriate tones in sequence to the outputs of the microcomputer. FIG. 5 also shows a light source as part of the output circuit. When output circuits of this type are housed in a bell shaped translucent housing and configured as illustrated in FIG. 4, a distinctive and pleasing Christmas decoration is obtained. In this application of the preferred embodiment, the sequence of notes of eleven Christmas songs stored in ROM are played sequentially with each tone "ringing" and lighting one of the eight bells, producing a unique aural/visual effect.

Figure 6:
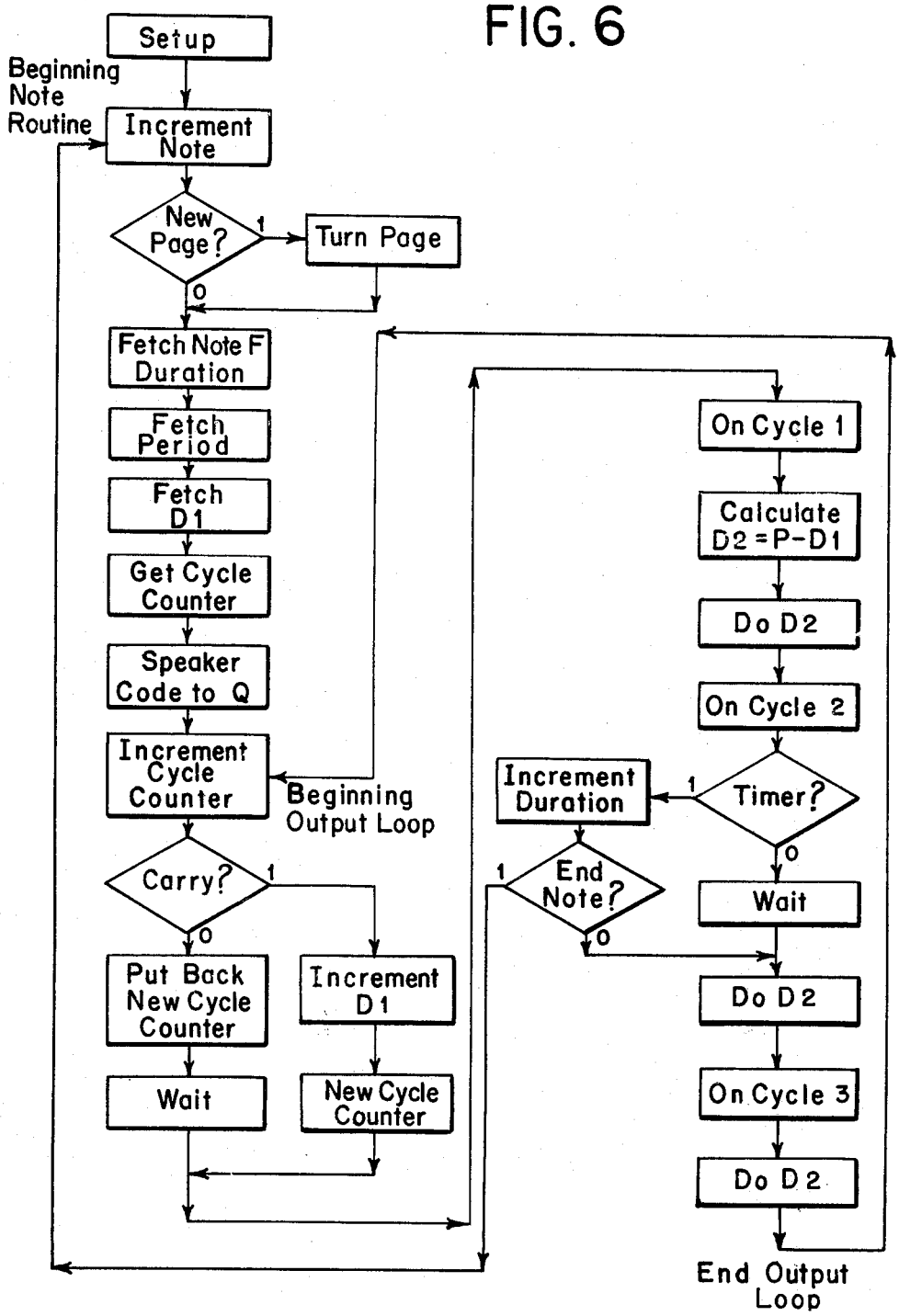
FIG. 6 is a flow chart of the program used in the application of the invention depicted in FIG. 4.

Referring now to FIG. 6 there is shown a flow chart of the program stored in the ROM of the microcomputer used in the bell tone generator application of the preferred embodiment. The blocks depicted therein represent a series of logical instructions, written in a code appropriate to the microcomputer being utilized (i.e. FIG. 3), causing the microcomputer to perform the following functions:

Setup:

1. Sets the three note-pointer digits in (RAM) Random Access Memory to the first data location in ROM
2. Loads from ROM into RAM eight values of decay rates (cycle counter)
3. Loads from ROM into RAM the middle digit of the Jump In Direct (JID) (an instruction name) table pointer Increment Note:

1. Duplicates in another portion of RAM the Most Significant Digit (MSD) of the note pointer in RAM for future comparison with incremented note pointer
2. Increments note pointer New Page?:

Determines, by comparing note pointer MSD (before incrementing) with incremented note pointer, whether block number has changed, (The ROM of the COP420-/COP421 is structured in 256 byte blocks).

Turn Page:

If block has changed, to two or three, this routine sets the note pointer Least Significant Digit (LSD) to 3 (beginning data). If page has changed to four, sets note pointer to 1, 4, A (address in ROM of beginning of song data on block 1).

Fetch Note and Duration:

Using address in note pointer, this routine fetches and delivers to the Q register, one byte note and duration datum from appropriate block. The information is obtained via three instruction headings at top of each block. This routine also moves the information in the Q register to note pointer and duration locations in RAM.

Fetch Period:

Fetches the eight bit entry in the period table in ROM pointed to by the note register of RAM and loads it into the period register in RAM.

Fetch D1:

Fetches the eight bit entry in ROM in the Initial Delay 1 (D1) table pointed to by the note register and loads it into the D1 register in RAM (see table 1).

Get Cycle Counter:

Fetches four bit cycle counter value (Table 3B) pointed to by the D1 MSD from the table cycle counter in RAM and loads it into cycle counter register in RAM.

Speaker Code to Q:

Fetches the eight bit entry in the speaker code table in ROM pointed to by the note register in RAM and loads it into the Q register.

Increment Cycle Counter:

Loads the contents of cycle counter register into the ACC register (accumulator) and increments it.

Carry?:

If the incrementing of the cycle counter produces a carry, then increment D1, if not, go to Put Back New Cycle Counter.

Increment D1:

If the cycle counter increment carries, the D1 register in RAM is incremented, (since the MSD of D1 points to the cycle counter value in the cycle counter RAM table, each table value is used 16 times) D1 is never allowed to decay beyond some minimum length determined by the "overhead" number of commands required to execute a delay of $\phi$.

New Cycle Counter:

Performs same function as "get cycle counter" above.

Put Back New Cycle Counter:

If the cycle counter increment does not carry, this returns incremented value to the cycle counter register from the ACC register (accumulator).

Wait:

Provides wait time so that both path lengths (1 or 0) after "Carry?" are equal in execution time.

On Cycle 1:

For the first of three times during one output loop, enables the L outputs (Drivers) with the code set into the Q register (the speaker code) for the length of time stored in D1.

Calculate D2:

D2=P−D1. (period minus D1). Calculates (off time) D2 and stores it in the D2 register in RAM.

Do D2:

Disables L outputs and executes a delay for the time indicated by the D2 register.

On Cycle 2:

Enables the L outputs for the length of time stored in D1 for a second time during current output loop.

Timer?:

Checks condition of timer flag in the microcomputer. If set (1/256 second has elapsed since last flag), the duration register is incremented. If not, a wait is employed to equalize path lengths in execution time.

Increment Duration:

When timer flag (Skip Logic in FIG. 3) is set this routine increments the duration register in RAM. If in incrementing the LSD there is a carry the LSD is set at −7 and the next digit is incremented. If there is a carry, due to the incrementing of this digit, it is set at −6 and the MSD is incremented. These constants, −6 and −7, are values of parameters included so as to allow a great deal of latitude in setting the speed of execution of the data. They determine how fast the songs play. Thus, in testing the program, these numbers were varied and their values chosen empirically.

End Note?:

Tests for carry in incrementing entire duration register if there is a carry, the note is done; if not, output continues.

Wait:

Equalizes execution time path lengths after "timer?" inquiry.

Do D2:

Executes the D2 register delay as above.

On Cycle 3:

Enables the L output ports for third and last time during current output loop.

Do D2:

Executes the D2 register delay as above.

Table 1 is a table of the abbreviations used for the information stored in RAM in the above discussion of the program flow chart FIG. 6.

TABLE 1

| ABBREVIATION | DEFINITION |
|---|---|
| PER MSD | Period Most Significant Digit |
| PER LSD | Period Least Significant Digit |
| NOTE PER MSD | Note Pointer Most Significant Digit Stored in RAM by subroutine Increment note |
| D1 MSD | Delay 1 Most Significant Digit |
| D1 LSD | Delay 1 Most Significant Digit |
| JID TBL PTR | Jump InDirect Table Pointer |
| D2 MSD | Delay 2 Most Significant Digit |
| D2 LSD | Delay 2 Most Significant Digit |
| NOTE REG | Note Register |
| DUR MSD DUR DUR LSD | 3 Digit Duration Register |
| CYC CTR | Cycle Counter 8 Digit Table containing the cycle counter values given in Table 2 |
| NOTE PTR MSD NOTE PTR NOTE PTR LSD | 3 Digit Note Pointer Register |

As can be seen from the flow chart of FIG. 6 the series of rectangular waves generated for the specific embodiment of a bell tone generator are generated in groups of three. The reason for this is that the COP420/COP421 microcomputer has a minimum instruction execution time of four microseconds and the program used in the specific embodiment requires approximately 200 instructions for each output loop, it was thus necessary to increase the number of waves output before a change in the length of time for a logical "1" state could be made. This limitation, however, is due only to the properties of the particular digital logic system chosen to implement the specific embodiment and is not a limitation of the invention itself which could easily be implemented in digital logic which would permit a change in the length of time of the logical "1" state and thus the energy content of each wave in the series. A custom made integrated circuit embodiment of the program would be one example of such an implementation.

In order to obtain bell tones of substantially the same aural qualities as those of a tuned music bell, the following values were assigned to variables in the computer program.

TABLE 2*

| Note | Period** | Initial D1** | Initial Energy |
|---|---|---|---|
| 1 | 65 | 28 | .43 |
| 2 | 68 | 28 | .46 |
| 3 | 74 | 37 | .50 |
| 4 | 78 | 39 | .50 |
| 5 | 85 | 43 | .50 |
| 6 | 90 | 45 | .50 |
| 7 | 96 | 48 | .50 |
| 8 | 103 | 52 | .50 |
| 9 | 110 | 55 | .50 |
| A | 124 | 62 | .50 |
| B | 132 | 66 | .50 |
| C | 141 | 71 | .50 |
| D | 150 | 75 | .50 |
| E | 170 | 85 | .50 |
| F | 192 | 96 | .50 |

*Frequency range 1.3 KHZ–3.8 KHz Overhead is 37 four microsecond execution cycles.

**Values in terms of 4 microsecond execution cycles.

TABLE 3

| Cycle Counter Value Table* |
|---|
| 00 |
| 04 |
| 0C |
| 0D |
| 0F |
| 0F |
| 0F |
| 0F |
| 0F |

*In Hexidecimal notation as stored in RAM

While the invention has been described in connection with a specific embodiment which produces bell tones it is understood that the principles disclosed herein may be applied by those skilled in the art to obtain tones having the same aural qualities of a number of different musical instruments.

I claim:

1. A device for sounding musical notes comprising:
(a) at least one output means for producing sound;
(b) means for producing an electrical signal which alternates between two voltage levels;
(c) control means associated with said signal producing means for controlling the times at which said signal changes between said two voltage levels, said changes being selected to provide a predetermined energy content of each period of the fundamental frequency of each musical note so as to vary the intensity of each note over its duration; and
(d) means for transmitting said controlled electrical signal to said output means; whereby musical notes are sounded having substantially the same aural qualities as those produced by a musical instrument.

2. A device according to claim 1, wherein said control means includes;
(a) first memory means for storing data defining the length of each said period for each note;
(b) second memory means for storing data defining said predetermined energy content;
(c) arithmetic means for performing calculations with said stored data to determine the time of said signal changes in successive periods over the duration of each note corresponding to said predetermined energy content definition;
(d) register means for temporarily storing said data and results of said calculations; and
(e) logic means for executing the transfer of said data and results of calculations among said first memory means, said second memory means, said arithmetic means, said register means and said signal producing means so as to produce said variation of the intensity of each note over its duration.

3. A device in accordance with claim 1, wherein said output means further includes means for producing light responsive to said controlled electrical signal, whereby both light and sound are produced for each musical note.

4. A device for sounding musical notes comprising:
(a) at least one output means for producing sound;
(b) means for producing an electrical signal which alternates between two voltage levels;
(c) control means associated with said signal producing means for controlling the times at which said signal changes between said two voltage levels, said changes being selected to provide a predetermined energy content of each period of the fundamental frequency of each musical note so as to vary the intensity of each note over its duration;
(d) said predetermined energy content being at a maximum at the start of said musical note and then diminishing in a predetermined manner over the duration of the note; and
(e) means for transmitting said controlled electrical signal to said output means; whereby notes are produced having substantially the same aural qualities as tuned bells.

5. A device in accordance with claim 4, wherein the diminution of said predetermined energy content is selected to drive said output means at the highest practicable frequency, thereby diminishing production of harmonics.

6. A device according to claim 4, wherein said control device means includes;
(a) first memory means for storing data defining the length of each said period for each note;
(b) second memory means for storing data defining said diminishing predetermined energy content;
(c) arithmetic means for performing calculations with said stored data to determine the times of said signal changes in successive periods over the duration of each note corresponding to said diminishing predetermined energy content definition;
(d) register means for temporarily storing said data and results of said calculations; and
(e) logic means for executing the transfer of said data and said results of calculations among said first memory means, said secondary memory means, said arithmetic means, said register means and said signal producing means so as to produce said variation of the intensity of each note over its duration.

7. A device in accordance with claim 4; wherein said output means further includes means for producing light responsive to said controlled electrical signal, whereby both light and sound are produced for each musical note.

8. The devices of claims 1 or 4 further comprising:
(a) memory means for storing the sequence of the notes at least one musical composition; and
(b) means for accessing said memory means; said control means and said signal producing means for selecting in sequence the musical tones corresponding to the notes of said musical composition; thereby playing the musical composition.

* * * * *